US006638147B2

(12) United States Patent
Shiino et al.

(10) Patent No.: US 6,638,147 B2
(45) Date of Patent: Oct. 28, 2003

(54) POLISHING METHOD FOR REMOVING CORNER MATERIAL FROM A SEMI-CONDUCTOR WAFER

(75) Inventors: Masami Shiino, Odawara (JP); Shinji Toda, Fujisawa (JP); Tomohiro Aizawa, Yokohama (JP); Tsukasa Taniwaki, Zama (JP)

(73) Assignee: Speedfam Co., Ltd., Ayase (JP)

( * ) Notice: Subject to any disclaimer, the term of this patent is extended or adjusted under 35 U.S.C. 154(b) by 78 days.

(21) Appl. No.: 10/162,225

(22) Filed: Jun. 5, 2002

(65) Prior Publication Data

US 2002/0182985 A1 Dec. 5, 2002

(30) Foreign Application Priority Data

Jun. 5, 2001 (JP) ..... 2001-170212

(51) Int. Cl.[7] ..... B24B 1/00
(52) U.S. Cl. ..... 451/44
(58) Field of Search ..... 451/41, 43, 44, 451/60, 177, 179, 259, 289, 402, 403; 428/622, 633

(56) References Cited

U.S. PATENT DOCUMENTS 6,242,337 B1 * 6/2001 Okada ..... 438/622
6,268,090 B1 * 7/2001 Matsubara et al. ..... 430/5
6,422,930 B2 * 7/2002 Hakomori ..... 451/325

FOREIGN PATENT DOCUMENTS

| | | |
|---|---|---|
| JP | 02-301135 | 12/1990 |
| JP | 03-026459 | 2/1991 |
| JP | 07-040214 | 2/1995 |
| JP | 09-186234 | 7/1997 |
| JP | 10-312981 | 11/1998 |
| JP | 2000-068273 | 3/2000 |

* cited by examiner

*Primary Examiner*—Joseph J. Hail, III
*Assistant Examiner*—Shantese McDonald
(74) *Attorney, Agent, or Firm*—Morrison & Foerster LLP

(57) ABSTRACT

In the polishing apparatus, the rotating corner polishing member is positioned so that its edge is aligned with the edge of the insulation film, and a pressing means applied the corner polishing member to the metal film of the periphery thereof. The metal film is removed by the rotary driven polishing member and slurry supplied to the polishing area. The metal portion penetrated in the corner formed by the side wall of the insulation film and the surface of the semi-conductor wafer substrate that is extremely difficult to be removed by the conventional removal method, can be removed substantially completely.

6 Claims, 4 Drawing Sheets

POLISHING METHOD FOR REMOVING CORNER MATERIAL FROM A SEMI-CONDUCTOR WAFER

BACKGROUND OF THE INVENTION

1. Field of the Invention

The present invention relates to a polishing method and an apparatus for removing corner material penetrated into a corner formed by a side wall of an insulation film on a semi-conductor wafer and a front surface of the wafer.

2. Background of the Invention

FIGS. 1A to E are illustrative drawings for illustrating a part of processing of semi-conductor wafer surface. A semi-conductor wafer W is a circular plate having a front plane surface 2*p,* a back plane surface 2*q,* a front beveled surface 2*a,* a back beveled surface 2*b,* and a side surface 3. An insulation film I made of silicone oxide film is formed on the front plane surface 2*p* of the semi-conductor wafer W (FIG. 1A). Next, trenches or grooves T for forming a wiring are formed on the insulation film I (FIG. 1B), and further, a metal film M is formed on an oxide film I (FIG. 1C). At this time, the metal is penetrated into the trenches. The film M is removed so as to leave the metal in the trenches T (FIG. 1E). The metal remaining in the trenches T become the wirings of a semi-conductor device.

From the nature of the metal film forming method, unnecessary metal film portions M1, M2, M3 are formed on the external area of the insulation film area, namely on a part of the front plane surface 2*p* and on the surfaces 2*a,* 3 and 2*b*.

In order to remove the metal film M on the oxide film I to form the wirings, a chemical mechanical polishing (CMP) process is performed. In the CMP process, if a part of the metal film M peels off and the peel fragment is engaged between the oxide film and a polishing tool, the oxide film surface is scratched. The scratches decrease the yield of the semi-conductor device manufacturing and moreover metal film portions M1, M2, M3 are easy to peel off. Therefore, these metal film portions M1, M2, M3 are removed before the CMP process (FIG. 1D).

It should be appreciated that a swell called "rebound" is sometimes left on the oxide film when the CMP process is performed without removing the metal film portions M1, M2, M3. When the "rebound" is removed in a separate process, the necessary portion tends to be removed and therefore the uniformity of the film thickness is deteriorated. From the respect also, it is extremely difficult to perform the CMP process with the metal films M1, M2, M3 attached.

Japanese Laid-Open Patent Application No. 2000-068273 discloses a technology for removing the metal film of the periphery of the insulation film I after removing the metal film on the surface of the insulation film I by the CMP method. The technology takes into consideration a fact that the metal film of the periphery thereof is easily contaminated in the following process and the contaminated film tends to peel off, and is characterized by that it is performed after the CMP process. Therefore, this does not solve the problem that the metal film of the periphery peels off during the CMP process as in the present invention.

Japanese Patent Application Laid-Open No. Hei No. 10-312981 (Patent No. 3111928) discloses the removal of metal film of the periphery thereof, before removing the metal film M on the insulation film I by the CMP method. The removing of metal film of the periphery is performed by submerging the entire wafer into an oxidant solution in an etching vessel, or by pressing the wafer to a polishing pad so that the wafer periphery penetrates into the pad under the pressure.

In the former case, it is supposed that a metal film of an appropriate thickness of such a order allowing to perform the CMP can be left on the insulation film, when the peripheral metal film is removed. However, as the method depends on an etching speed, it is not reliable, and moreover it causes a problem that an optimal kind of etching solution must be selected.

The problem of the dependency on the etching speed can be solved by protecting the metal film on the insulation film from etching with a masking, there is caused, however, another problem of implementation of masking process or a process for removing the same. In either case, as it is impossible to remove the peripheral metal film perpendicularly to the semi-conductor wafer base member from the insulation film, a part of a metal film M' (FIG. 1D) remains at the corner portion of the insulation film and the semi-conductor wafer base member. This will peel off in the following CPM process, causing scratch.

On the other hand, in the latter case (removing method for pressing the wafer periphery to the polishing pad so that it penetrates into the pad under the pressure), the point that can be polished depends on the deformation of the polishing pad, and the polishing effect is not exerted sufficiently up to the corner portion, leaving a part of the metal film M' (FIG. 1D) easily. As in the former case, this will peel off in the following CPM process, causing scratch.

SUMMARY OF THE INVENTION

It is an object of the present invention to provide a method and an apparatus for removing substantially completely the metal film portions M1, M2 and M3 of the metal film M of the semi-conductor wafer periphery, before a chemical mechanical polishing of the metal film on the insulation film surface. Moreover, it is another object of the present invention to prevent peel fragments from being engaged between the oxide film and a polishing tool during the CMP process, and thereby to improve the yield of the semi-conductor device manufacturing.

According to the present invention, in a semi-conductor wafer where a metal film is formed on the surface of the insulation film and the surface of a periphery thereof where the insulation film is not formed, the metal film of the periphery thereof is removed before chemical mechanical polishing of the metal film on the insulation film surface. The metal portion penetrated in the corner portion formed by the side wall of the insulation film and the surface of the semi-conductor base member that it is extremely difficult to be removed by the conventional removal method, can be removed substantially completely by the effect of a rotary driven polishing member, and a slurry supplied to a polished portion. The semi-conductor wafer from which the peripheral film including the metal portion of the corner portion is removed is rinsed with pure water, and transferred to the CMP process for removing the metal film on the insulation film surface. As there is no metal portion in the corner portion, the metal portion will never peel off during the CMP process. Therefore, peel fragments engaged between the polishing member and the insulation film will not cause a scratch on the insulation film surface.

In the polishing apparatus of the present invention, a rotary corner polishing member is positioned to align its edge with the edge of the insulation film and a pressing means apply the corner polishing member to the metal film of the periphery thereof. The metal film of the periphery thereof including metal portions of corner portions is removed substantially completely by the rotary driven polishing member and slurry supplied to the polished portion.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of various embodiments of the invention, and therefore reference is made to the claims which follow the description for determining the scope of the invention.

DETAILED DESCRIPTION ON PREFERRED EMBODIMENTS

Figure 1A:
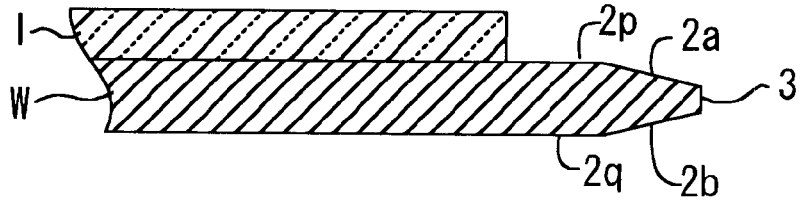
FIG. 1A PRIOR ART
FIGS. 1A to E are illustrative drawings for illustrating a part of processing of semi-conductor wafer surface.
Figure 1B:
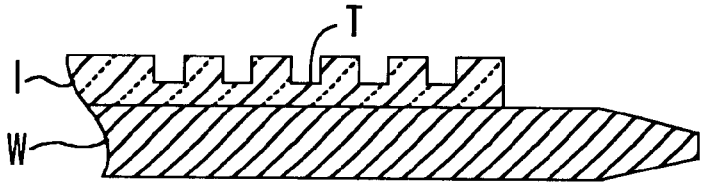
FIG. 1B PRIOR ART
Figure 1C:
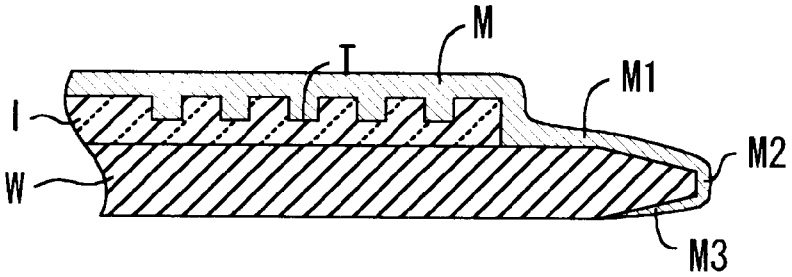
FIG. 1C PRIOR ART
Figure 1D:
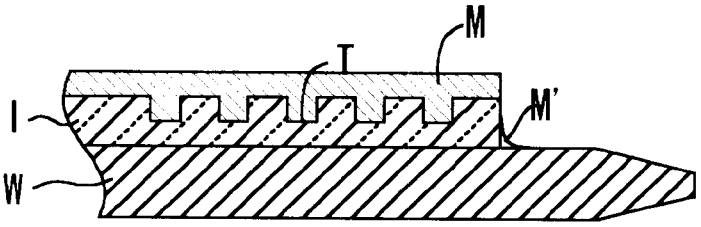
FIG. 1D PRIOR ART
Figure 1E:
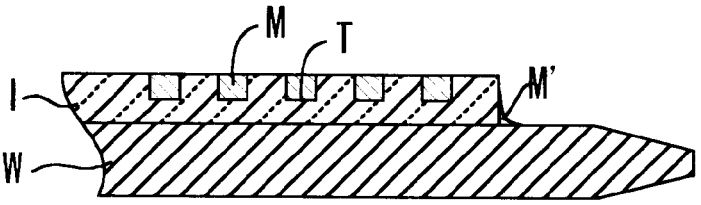
FIG. 1E PRIOR ART
Figure 2:
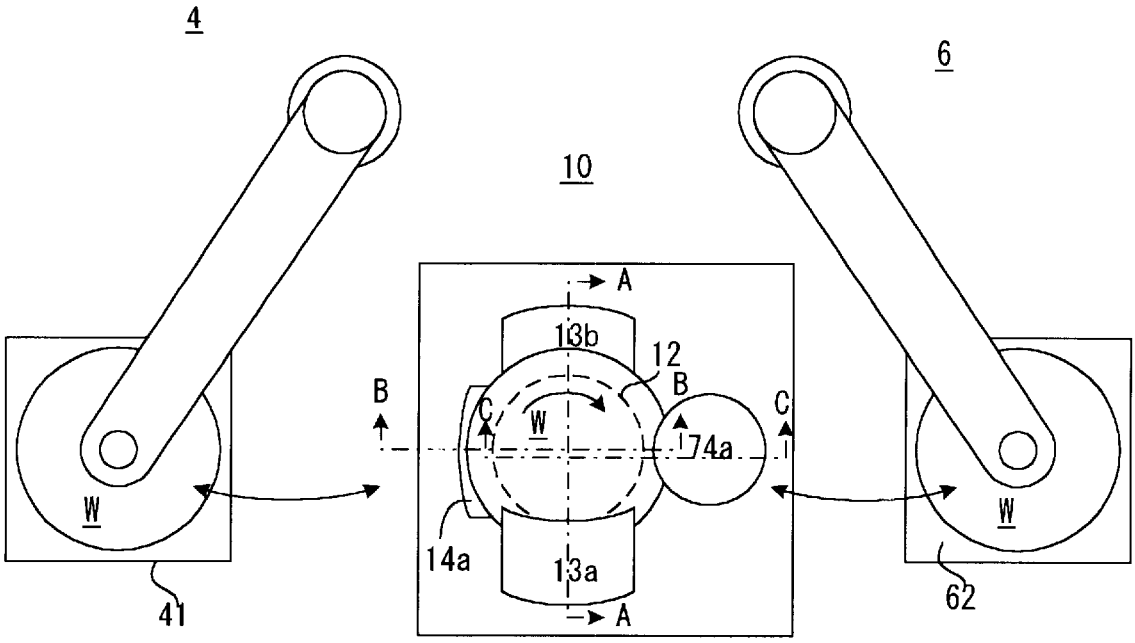
FIG. 2 is a top view showing schematically a polishing apparatus, a work carry-in apparatus and a work carry-out apparatus according to the invention.

Now, embodiments according to the present invention shall be described. In the present invention, metal films M1, M2, M3 of the periphery thereof are removed, before sending a semi-conductor wafer wherein a metal film M is formed on the surface of the insulation film and the surface of the periphery thereof is transferred to the CMP process. At this moment, a metal M' at corner portions is also removed completely. The semi-conductor wafer from which the metal film of the periphery thereof is removed is shower rinsed with pure water and transferred to the following CMP process. Now, the method invention and embodiments of polishing apparatus thereof shall be described. FIG. 2 is a top view showing schematically a polishing apparatus 10, a work carry-in apparatus 4 and a work carry-out apparatus 6 according to the invention.

A semi-conductor wafer, as shown in FIG. 1 wherein an insulation film I and a metal film M thereon are formed (called "work" hereinafter) is transferred from the upstream thereof, and placed on a rest table 41. The arm-shape work carry-in apparatus 4 absorbs the work W on the rest table 41, and pivots to transfer the same on a chuck means 12 on a polishing apparatus 10. As described below, the polishing apparatus 10 polishes and removes unnecessary metal portion from the outer circumference of the work, by rotating the semi-conductor wafer (work) W by a predetermined amount or during a predetermined time.

The work carry-away apparatus 6, which is substantially similar to the work carry-in apparatus 4, absorbs the work W from the chuck means 12 upon completion of the outer circumferential polishing of the work W, pivots and places the same on the rest table 62. The work W placed on the rest table 62 is transferred further downstream by another transfer means, shower rinsed and submitted to the CMP process. The wiring is formed by removing the metal film M on the insulation film I in the CMP process.

The polishing apparatus 10 of the embodiment includes a chuck means 12 for chucking a disk-shape work W and rotating the same around the axial line thereof, a pair of polishing members 13*a,* 13*b* for beveled surface for polishing beveled faces 2*a,* 2*b* of the work W held by the chucking means 12, a side polishing member 14*a* for polishing the side surface 3 of the work W, and, a corner polishing member 74*a* for polishing the aforementioned corner portion.

Figure 3:
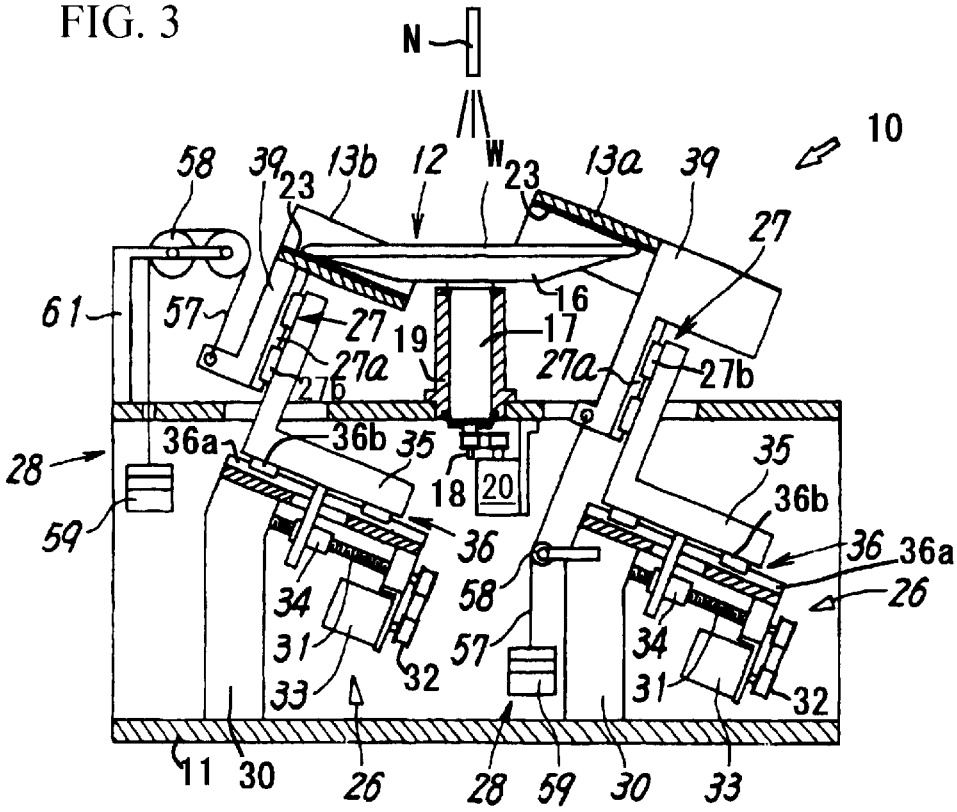
FIG. 3 is a section view along A—A in FIG. 2, showing a pair of polishing members for beveled surfaces, and the composition related thereto.

FIG. 3 is a section view along A—A in FIG. 2, showing the pair of bevel polishing members 13*a,* 13*b,* and the composition related thereto. The chuck means 12 has a chuck table 16 constituting a disk shape having a diameter slightly smaller than the work W, and the work W can be held horizontally on the chuck table 16 in a state where the outer edge is protruding laterally from the chuck table 16 by vacuum absorption. Therefore, a plurality of absorption holes are open on the top face of the chuck table 16, and these absorption holes are connected to a not shown vacuum pump from a passage in a support shaft 17 through a connection port 18.

In addition, the support shaft 17 is supported rotatably by a bearing member 19 around the perpendicular axial line on a machine body 11, and configured to be driven and rotated in normal and reverse necessary directions by an electric motor 20 at a required speed. A slurry supply nozzle N for supplying the work W surface with slurry is installed above the chuck table 16. It should be appreciated that the means for chucking the work W on the chuck table 16 is not limited to the vacuum absorption as mentioned above, but an electrostatic chuck using electrostatic adhesion or other convenient methods can also be used.

The bevel polishing member 13*a,* 13*b* is the one wherein arc form recesses are formed in a rigid base body made of metal, synthetic resin or ceramics or the like, and a concave arc form working surface in line contact with the outer circumference of the work W is formed, by pasting a flexible polishing pad 23 to the inner face of the recess. Polishing concave groove for engaging with the work is absent on the surface of the polishing pad 23. However, it is possible to provide a slurry groove for improving the slurry flow.

As it is obvious also from FIG. 3, two bevel polishing members 13*a,* 13*b* having a substantially same configuration are disposed with their respective axial lines slant to the axial line of the work W, at opposed positions at both ends of the diametric direction of the work W held by the chuck means 12. The working surface of the bevel polishing member 13*a* is in contact with substantially the entire width of the front beveled surface 2*a* of the work W, while the working surface of the bevel polishing member 13*b* is in contact with substantially the entire width of the back beveled surface 2*b* of the work W.

It is preferable that the length of the arc of the working surface of the polishing member 13*a,* 13*b* is equal or inferior to ¼ of the length of the circumference of the work W, while, the curvature of the working surface is equal or slightly inferior to the curvature of the circumference of the work W.

The polishing apparatus 10 is, moreover, supported by displacement mechanisms 26, 26 for moving the bevel polishing members 13*a,* 13*b* in a direction substantially along the slope of the beveled surface 2*a,* 2*b* of the work W, and respective linear guide mechanisms 27, 27 so as to allow the displacement in a direction (direction in contact with and separating from the beveled surface 2*a,* 2*b* of the work W) perpendicular to the displacement direction. Each linear guide mechanism 27, 27 is provided with a pressing means 28, 28 for applying a polishing pressure, for biasing each bevel polishing member 13*a,* 13*b* in a direction in contact with the beveled surface 2*a,* 2*b*.

The displacement mechanism 26, 26 moves the polishing member 13*a,* 13*b* at the beginning or end of polishing work or others for coming into contact with the work W or separating from the work W, and at the same time, changes the contact position of the polishing member in respect to the work W during the polishing. Respective displacement mechanisms 26 have a ball screw 31 installed in parallel with the axial line of the polishing member 13*a,* 13*b* on a bracket 30 provided on a machine body 11, an electric motor 33 for rotating the ball screw 31 via a timing belt 32, a nut member 34 screw joint with the ball screw 31 and moving ahead and back by the rotation of the ball screw 31, a movable table 35 coupled with the nut member 34 and moving therewith, and a sliding mechanism 36 movably supporting the movable table 35. On respective movable tables 35, the polishing member 13*a,* 13*b* is supported through respective linear guide mechanisms 27. The sliding mechanism 36 is composed of a rail 36*a* disposed in parallel with the ball screw 31 and a slider 36*b* provided on the movable table 35 sliding on the rail 36*a*.

Respective linear guide mechanisms 27 have a rail 27*a* provided on a holder 39 holding the polishing members 13*a,* 13*b* and extending in a direction perpendicular to the axial direction of the polishing members 13*a,* 13*b* and a slider 27*b* attached to the movable table 35 and movable on the rail 27*a*. It is possible to reverse their relation.

The pressing means 28 for the bevel polishing member 13*a* is configured as follows. One end of a wire 57 is coupled with a holder 39 supporting the bevel polishing member 13*a,* while the other end of the wire 57 extends downward slant in parallel with the rail 27*a* of the linear guide mechanism 27, is wound around a pulley 58 attached to the bracket 30 and changes to the perpendicular direction, and a weight 59 is hung at the lower end thereof. The gravity of the weight 59 biases the bevel polishing member 13*a* downward slant along the rail 27*a,* imparting a polishing pressure of the bevel polishing member 13*a*.

On the other hand, as for the bevel polishing member 13*b,* the wire 57 of which one end is coupled with a holder 39 is directed upward slant in parallel with the rail 27*a* of the linear guide mechanism 27, wound around a pulley 58 supported by a bracket 61 on the machine body 11 and changes the direction downward, and a weight 59 is hung at the lower end thereof. The gravity of the weight 59 biases the bevel polishing member 13*b* slant upward, imparting a necessary polishing pressure.

It should be appreciated that an appropriate feeding mechanism is provided respectively for retrogressing the respective holders 39 by a fixed distance and stopping against the weight of the respective weight 59, so that respective polishing members 13*a,* 13*b* can be held at a position separated from the work W when the polishing is not performed.

The contact position of the bevel polishing members 13*a,* 13*b* and the work W can be changed conveniently, by moving the polishing members 13*a,* 13*b* respectively to the right or to the left along the axial line thereof through the rotation of the ball screw 31 of the displacement mechanism 26. The polishing pressure of the polishing members 13*a,* 13*b* and the work W can be adjusted conveniently by the weight of the weight 59. In addition, at the beginning and at the end of the polishing operation, the bevel polishing member 13*a* is moved to the right while the bevel polishing member 13*b* is moved to the left (FIG. 3). Thus, as these polishing members 13*a,* 13*b* are separated from the work W, the work W can be brought or carried away.

Figure 4:
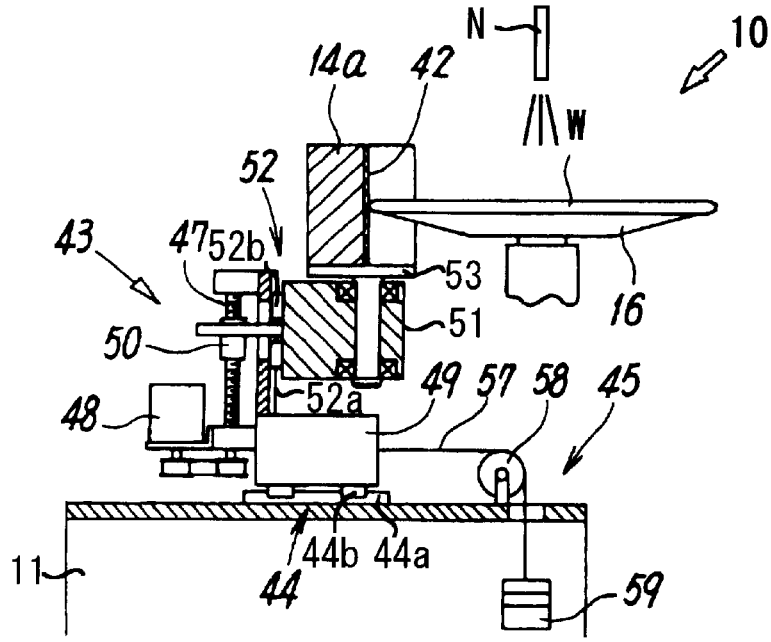
FIG. 4 is a section view along B—B in FIG. 2, showing a polishing member for polishing the side surface of a work W, and the composition related thereto.

FIG. 4 is a section view along B—B in FIG. 2, showing a side polishing member 14*a* for polishing the side surface 3 of a work W, and the composition related thereto. The side polishing member 14*a* has a concave arc-shape working surface 42 of a configuration substantially similar to the bevel polishing members 13*a,* 13*b*. Therefore, it is possible to provide a slurry groove for improving the slurry flow on the working surface 42, but a concave groove for polishing in which the work would be fitted can not be provided. The side polishing member 14*a* is arranged with its axial line in parallel with the axial line of the work W, at a position different by 90 degrees from the bevel polishing members 13*a,* 13*b*. The side surface 3 (see FIG. 1) is polished by applying the working surface 42 perpendicularly to the work W.

It is preferable that the length of the arc of the working surface 42 is equal or inferior to ¼ of the length of the circumference of the work W, while, the curvature of the arc is equal or slightly inferior to the curvature of the circumference of the work W.

A displacement mechanism for moving the side polishing member 14*a* in parallel with the axial line of the work W, a linear guide mechanism 44 for movably supporting in a direction perpendicular to the axial line, and a pressing means 45 for applying polishing pressure are provided.

The displacement mechanism 43 has a ball screw 47 extending in parallel with the axial line of the side polishing member 14*a,* an electric motor 48 for rotating the ball screw 47, a movable table 49 supporting these ball screw 47 and the electric motor 48, a nut member 50 screw coupled with the ball screw 47 and moving up and down by the rotation of the ball screw 47, and a support member 51 coupled with the nut member 50 and moving therewith, and a sliding mechanism 52 guiding the displacement of the support member 51. The side polishing member 14*a* is attached to the support member 51 through a holder 53. The sliding mechanism 52 is composed of a rail 52*a* disposed in parallel with the ball screw 47 on the movable table 49 and a slider 52*b* attached to the support member 51 and sliding on the rail 52*a*.

The linear guide mechanism 44 has a rail 44*a* provided on the machine body 11 and extending in a direction perpendicular to the axial direction of the side polishing members 14*a,* and a slider 44*b* attached to the movable table 49 and movable on the rail 44*a*.

The wire 57 coupled with the movable table 49 is wound around a pulley 58 on the machine body 11 and changes the direction downward, and a weight 59 is hung at the lower end thereof. The gravity of the weight 59 biases the movable table 49 towards the work W side, imparting a necessary polishing pressure.

During the polishing, the position of the working surface 42 in contact with the work W can be changed, by moving the side polishing members 14*a* up and down by operating the displacement mechanism 43. In addition, a feed means (not shown) for separating the side polishing members 14*a* from the work W against the weight of the weight 59 is provided.

Figure 5:
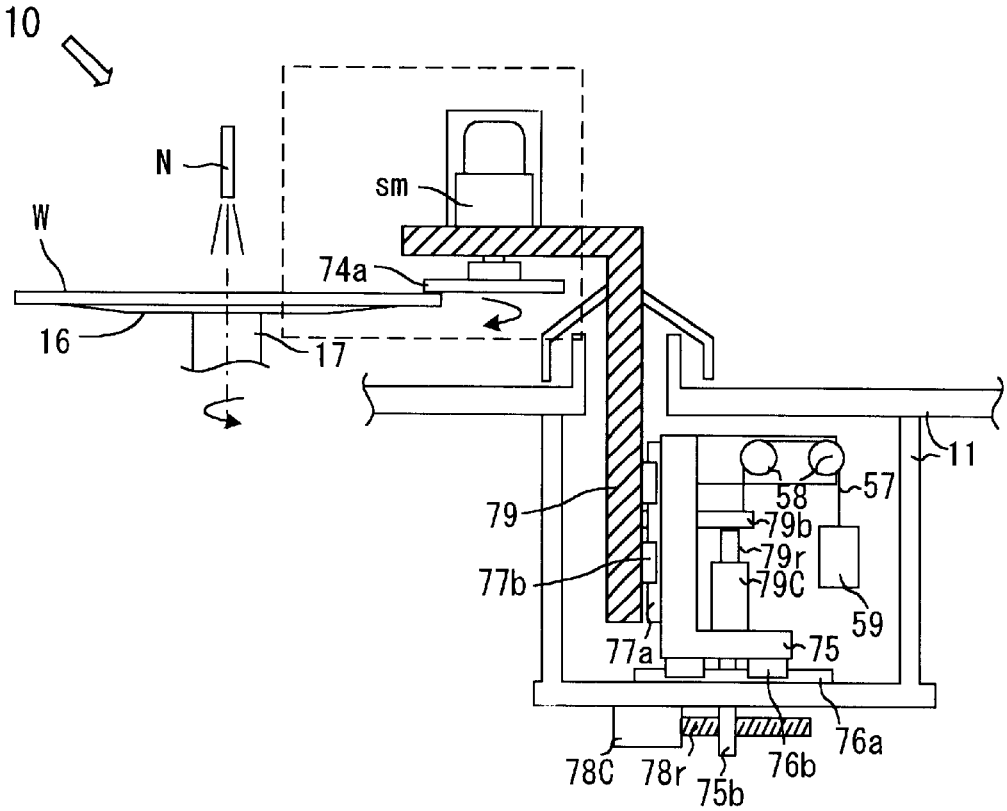
FIG. 5 is a section view along C—C in FIG. 2, showing a corner polishing member for polishing the corner portion of the work W, and the composition related thereto.

FIG. 5 is a section view along C—C in FIG. 2, showing a corner polishing member 74*a* for polishing the corner portion of the work W, and the composition related thereto. The corner polishing member 74*a* is a disk shape polishing member rotationally driven by a spindle motor sm.

On the machine body 11, a rail 76*a* extends in a direction orthogonal to the axial line of the work W, and a movable table 75 is made slidable through a slider 76*b* placed thereon. Further, on the movable table 75, a rail 77*a* extends in the axial direction of the work W, and a holder table 79 is made slidable through a slider 77*b* placed thereon.

A feed motor 78C for driving a feed screw 78*r* is fixed on the machine body 11, and the feed screw 78*r* meshes with the female screw of a female screw member 75*b* fixed in the lower part of the movable table 75. When the feed motor 78C rotates, the feed screw 78*r* rotates, and the movable table 75 moves right and left in the drawing, in short, in a direction separating from or approaching the axial line of the work W, through the female screw member 75*b* meshed therewith. The relative position of the edge of the corner polishing member 74*a* in respect to the work W is controlled by controlling the rotary amount of the feed motor 78C.

A contactor 79*b* is fixed to the holder table 79. A piston cylinder mechanism 79C is installed on the movable table 75, and when the piston cylinder mechanism 79C is elongated, a piston rod 79*r* thereof pushes up the contactor 79*b* upward. Thereby, the corner polishing member 74*a* moves upward, in short, in a direction away from the work W.

One end of the wire 57 is fixed to the contactor 79*b,* and the wire 57 is engaged between two pulleys 58 rotatably supported by the movable table 75 and attached to the weight 59. The weight 59 is to compensate the polishing pressure to the work W, in short, the weight of the holder table 79, spindle motor sm, corner polishing member 74*a* and other members, and regulates so that a convenient polishing pressure can be obtained.

For the polishing operation, first, the piston cylinder mechanism 79C is elongated, and the holder table 79 is pushed upward by the piston rod 79*r.* Thereby, the corner polishing member 74*a* also rises. Next, drive the motor 78C to move the corner polishing member 74*a* to the right (retreat position). At the same time, move the other polishing members, in short, the bevel polishing member 13*a,* 13*b* and the side polishing members 14*a* to their respective retreat positions. The work carry-away apparatus 6 takes out a polished work from the chuck means 12, while the work carry-in apparatus 4 places a new work W on a chuck means 12. Next, the chuck means 12 holds the work W and start to rotate. Control the feed motor 78C and align the edge of the corner polishing member 74*a* with the edge of the insulation film I mentioned above. Next, drive the spindle motor sm to start the rotation of the corner polishing member 74*a*. The other polishing members (the bevel polishing members 13*a,* 13*b* and the side polishing members 14*a*) are also moved to their respective polishing positions to start the polishing. The piston cylinder mechanism 79C contracts, the corner polishing member 74*a* descends, and the corner polishing member 74*a* and the work W come into contact to start polishing.

Thus, the metal films M1, M2, M3 are polished by the bevel surface polishing members 13*a,* 13*b,* the side polishing member 14*a* and the corner polishing member 74*a*. The metal film M' of the corner portion that was difficult to remove conventionally can also removed, because the position of the edge of the corner polishing member 74*a* agrees with the position of the edge of the insulation film 1, and moreover, slurry is supplied sufficiently by the rotation of the corner polishing member 74*a,* as mentioned above.

Moreover, a same place of a polishing member does not always exert the polishing effect as in case of using a non-rotatry polishing member, but, the corner polishing member 74*a* rotates, thereby, distributing the polishing load applied to a unit length of the edge thereof. Thus, the edge of the corner polishing member 74*a* deforms less, lowering the frequency of dressing (shape rectification).

Figure 6:
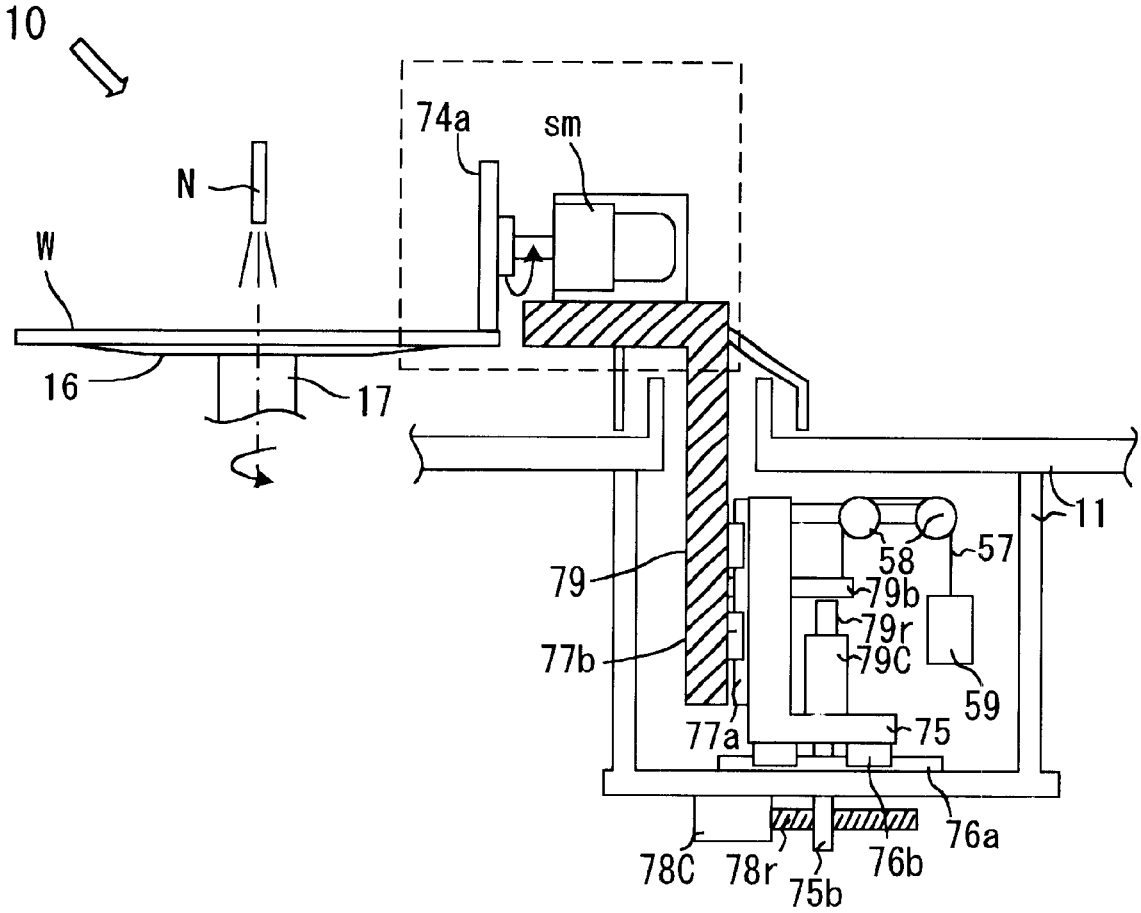
FIG. 6 is a section view of another example wherein the structure is modified so that the rotary axis of the corner polishing member becomes perpendicular to the rotary axis of the work W.

Hereinabove, examples of a case wherein the corner polishing member 74*a* is provided with an axis parallel to the axis of the work W were described. The structure can be modified so that the rotary axis of the corner polishing member 74*a* is perpendicular to the rotary axis of the work W. In the variation, as shown in FIG. 6, it is so configured that the spindle motor sm, and consequently, the axis of the corner polishing member 74*a* attached to the same is horizontal, or, orthogonal to the axial line of the work W. The portion surrounded by dotted lines in FIG. 5 and FIG. 6 represents the portion corresponding to the modification. Repeated description of the other structure, operation, polishing function and effects shall be omitted.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A polishing method for removing corner material penetrated into a corner formed by a side wall of an insulation film on a semi-conductor wafer and a front surface of said wafer, said corner material being a part of a metal film formed on said insulation film and a periphery of said insulation film on said wafer; wherein removing of said corner material is performed by a rotary driven polishing member and slurry supplied to a polishing area before a chemical mechanical polishing process for removing said metal film on said insulation film.

2. A polishing method according to claim 1, wherein other parts of said metal film is polished by respective polishing members at the same time.

3. A polishing method according to claim 2, said wafer is rinsed by pure water shower after said entire peripheral metal film is polished.

4. A polishing apparatus for removing corner material penetrated into a corner formed by an end wall of an insulation film on a semi-conductor wafer and a front surface of said wafer, said corner material being a part of a metal film formed on said insulation film and a periphery of said insulation film on said wafer, comprising;

a chuck means for supporting said semi-conductor wafer, a first journal means for rotatably supporting said chuck means, a wafer driving means for rotationally driving said chuck means, a corner polishing member for removing said corner material from said semi-conductor wafer, a polishing member support means for supporting said corner polishing member, a second journal means for rotatably supporting said polishing member support means, a polishing member driving means for rotationally driving said polishing member support means, a positioning means for relatively positioning said corner polishing member and said chuck means so as to align an edge of said corner polishing member and an edge of said insulation film, a pressing means for pressing said corner polishing member to the metal film of said periphery in order to remove said corner material, and a slurry supply means for supplying slurry to a polishing area, wherein a bevel polishing member for removing a metal film on a beveled surface of said semi-conductor wafer and a side polishing member for removing a metal film on a side surface of said semi-conductor wafer are arranged around said chuck means.

5. A polishing apparatus according to claim 4, wherein said pressing means comprises;

a weight, a wire whose one end is fixed to said weight and the other end to said second journal means, and a pulley to which said wire is engaged.

6. A polishing apparatus according to claim 5, further comprising;

a carry-in means for carrying said semi-conductor wafer to said chuck means from the outside, and a carry-out means for carrying said semi-conductor wafer out from said chuck means to the outside.

* * * * *